United States Patent [19]

Landa

[11] Patent Number: 4,501,486

[45] Date of Patent: Feb. 26, 1985

[54] WIPER BLADE FOR ELECTROPHOTOCOPIER

[75] Inventor: Benzion Landa, Edmonton, Canada

[73] Assignee: Savin Corporation, Stamford, Conn.

[21] Appl. No.: 513,725

[22] Filed: Jul. 14, 1983

[51] Int. Cl.[3] ..... G03G 21/00

[52] U.S. Cl. ..... 355/15; 15/256.5; 15/1.5 R

[58] Field of Search ..... 355/15, 3 R; 15/1.5, 15/256.5, 256.51; 118/652

[56] References Cited

U.S. PATENT DOCUMENTS 4,255,044 3/1981 Cormier et al. ..... 355/15

4,259,003 3/1981 Mangal et al. ..... 355/15 X

FOREIGN PATENT DOCUMENTS 88162 7/1981 Japan ..... 355/15

*Primary Examiner*—Richard L. Moses

*Attorney, Agent, or Firm*—Shenier & O'Connor

[57] ABSTRACT

A blade for cleaning toner from a liquid developed imaging surface comprises a body of high conductivity formed of rubber impregnated with carbon particles and a tip contacting the imaging surface formed of an inherently conductive rubber of lesser conductivity, the liquid developer affecting the conductivity of the body but not that of the tip, and the tip being replaceably inserted in a cooperating re-entrant cavity of large surface area formed in the body to provide a low contact resistance therebetween.

9 Claims, 2 Drawing Figures

WIPER BLADE FOR ELECTROPHOTOCOPIER

FIELD OF THE INVENTION

My invention relates to an improved wiper blade for use in the conductive cleaning station of an electrophotocopier.

BACKGROUND OF THE INVENTION

Cleaning stations are used in electrophotocopiers to remove residual toner particles from the surface of a photoconductive drum each time a copy is made. Typically, as shown in U.S. Pat. No. 4,259,003, these cleaning stations include a conductive cleaning roller engaging the surface and rotating in the opposite direction and a conductive wiper blade. The roller and blade are supplied with biasing potentials to assist in the removal of the charged toner particles from the image-bearing photoconductive surface. The removed particles are flushed away by cleaning liquid, which is directed into a trough created between the roller and the wiper blade.

It is preferable to form the wiper blade from material which is highly compliant, thus allowing the tip of the blade to maintain contact with the drum surface without excessive pressure. The blade material must also be conductive and capable of maintaining its conductivity in the presence of the cleaning liquid. In addition, it is preferable to form the blade of material which is inherently conductive as opposed to materials which are impregnated with carbon to render them conductive, as impregnation results in highly conductive hot spots which may be detrimental to the photoconductive surface. Furthermore, the conductivity is affected by the cleaning liquid which usually is a liquid developer. However, the bulk conductivity of inherently conductive, unimpregnated, compliant materials suitable for wiper blades is relatively low.

In cleaning stations of the prior art, the entire wiper blade is formed of inherently conductive material; and its electrical resistance is relatively high. Furthermore, when the tip of the blade becomes worn, the entire wiper blade must be replaced.

SUMMARY OF THE INVENTION

One object of my invention is to provide a wiper blade for a conductive cleaning station in which the tip and body of the wiper blade are formed of different materials.

Another object of my invention is to provide a wiper blade for a conductive cleaning station in which the tip of the blade is easily replaceable when it becomes worn.

Still another object of my invention is to provide a wiper blade for a conductive cleaning station which is inexpensive in construction.

A further object of my invention is to provide a wiper blade for a conductive cleaning station wherein the body of the blade is formed of a material impregnated to render it highly conductive and the tip of the blade is formed of an inherently conductive and unimpregnated material.

A still further object of my invention is to provide a compliant conductive wiper blade having a relatively low electrical resistance.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
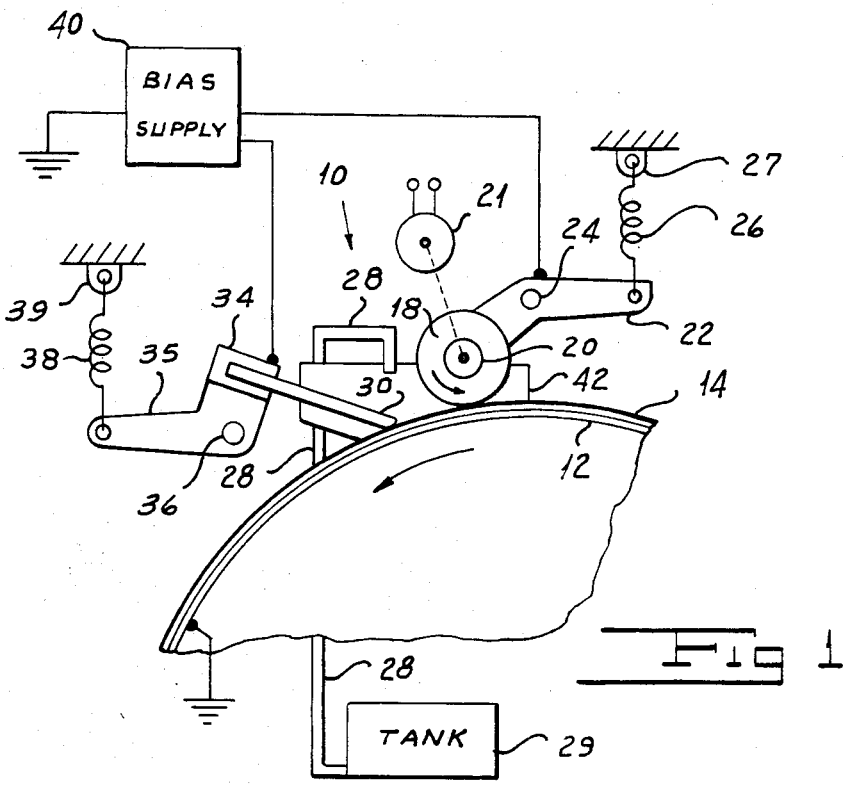
FIG. 1 is a fragmentary side view of a conductive cleaning station for an electrophotocopier incorporating my improved wiper blade.

Referring now to FIG. 1 of the drawings, an electrophotocopier includes a conductive cylindrical drum 12 having a photoconductive surface layer 14. The drum 12 is rotated counterclockwise by means not shown, past a cleaning station, indicated generally by the reference character 10, at which a cleaning roller 18 mounted on a shaft 20 is rotated counterclockwise by an electric motor 21. The roller 18 thus scrubs the photoconductive surface 14. Shaft 20 is journalled by conductive bearings in a pair of conductive bell cranks 22 which pivot on a stationary shaft 24. Cranks 22 are resiliently biased to move roller 18 downwardly toward the surface 14 by a pair of tension springs 26 secured to a pair of stationary mounts 27.

Wiper blade 30 is disposed to the left of roller 18 and extends downwardly and to the right, thus providing a chiseling action to loosen toner particles with rotation of drum 12. Wiper blade 30 is mounted in an elongated conductive yoke 34 which is secured to a pair of bell cranks 35. Cranks 35 pivot on a stationary shaft 36 and are biased to move blade 30 downwardly toward surface 14 by a pair of tension springs 38 secured to a pair of stationary mounts 39. A power supply 40 provides biasing potentials opposite in polarity to that of the electrostatic image upon photoconductive surface 14 which are applied to one of cranks 22 and to yoke 34. Drum 12 is grounded; and supply 40 is provided with a circuit ground connection.

Cleaning liquid, which may comprise liquid developer, within a reservoir 29 is pumped, as is known to the art, through a pipe 28 which discharges into a trough formed by blade 30, roller 18, and that portion of surface 14 therebetween. Leakage from this trough is partially inhibited by a pair of stationary end plates 42.

Figure 2:
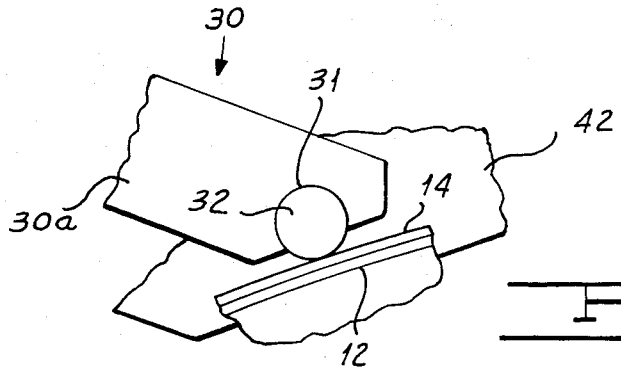
FIG. 2 is a fragmentary side view of my improved wiper blade on an enlarged scale.

Referring now to FIG. 2, body **30*a* of the wiper blade 30 is made from a highly compliant material such as rubber or neoprene which is heavily impregnated with particles such as carbon to render it highly conductive, so that its resistance is low. The body 30*a* is formed with a cylindrical recess 31, which subtends a central angle well in excess of 180°. I have shown a re-entrant recess 31 subtending 240°. A blade tip 32 is forced into recess 31 by flexing of the material of body 30*a* on either side of the recess. Tip 32 is held within recess 31 as the material of body 30*a* on either side of the recess flexes back to the position shown. Tip 32 is cylindrical and of substantially the same diameter as recess 31. Tip 32 is formed of a compliant and inherently conductive material such as epichlorohydrin rubber. While its conductivity is low, it is not affected by the carrier liquid, such as Isopar G (a trademark of Exxon Corporation), which is an isoparaffin commonly used in liquid developers. Since tip 32 and body 30*a* make contact over a central angle of 240°, the contact resistance is low. The area of contact is further well sealed against entry of liquid developer; and the contact resistance is constant. While the external surfaces of body 30*a* may be affected by liquid developer, the interior for the most part is not; and body 30***a* provides a low resistance path from yoke 34 to tip 32. Tip 32 is of relatively short length compared with body 30*a*; and although tip 32 has a high resistivity, it adds little to the total resistance between yoke 34 and surface 14.

When tip 32 becomes worn after extended use, it may readily be removed from body 30*a* and a new tip inserted in its place.

It will be seen that I have accomplished the objects of my invention. I have provided a low resistance wiper blade for use in the conductive cleaning station of an electrophotocopier in which the tip is formed of a different material than the body of the blade and is easily replaceable.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A blade for cleaning toner from an imaging surface, said blade having a body and having a tip which contacts said surface, said body being formed of a compliant material having a relatively low bulk resistivity, and said tip being formed of a compliant material having a relatively high bulk resistivity.

2. A blade as in claim 1 wherein the body is formed of a material impregnated with conductive particles.

3. A blade as in claim 1 wherein the tip is formed of an inherently conductive material.

4. A blade as in claim 1 wherein the body is formed of a material impregnated with conductive particles and the tip is formed of an inherently conductive material.

5. A blade for cleaning toner from an imaging surface, said blade having a body and having a tip which contacts said surface, said body and tip being formed of compliant materials having different bulk resistivities.

6. A blade for cleaning toner from an imaging surface, said blade having a body and having a tip which contacts said surface, the body being formed of a compliant conductive material and being provided with an elongated re-entrant cavity of relatively large surface area, said tip being formed of a compliant conductive material and including a portion having substantially the same shape as the cavity, said portion being adapted to be forced into the cavity, said large surface area providing a low contact resistance between the body and the tip.

7. A blade as in claim 6 wherein the cavity cross-section is generally circular and subtends a central angle which is appreciably greater than 180° and of the order of 240° and wherein the tip cross-section is generally circular.

8. A blade for cleaning toner from an imaging surface contacted by a liquid developer, said blade having a body and having a tip which contacts said surface, the body being formed of an electrically conductive and compliant material the conductivity of which is appreciably affected by the liquid developer, the tip being formed of an electrically conductive and compliant material the conductivity of which is minimally affected by the liquid developer.

9. A blade for cleaning toner from an imaging surface contacted by a liquid developer, said blade having a body and having a tip which contacts said surface, the body and tip being formed of electrically conductive and compliant materials the conductivities of which are differently affected by the liquid developer.

* * * * *